US006443387B1

(12) United States Patent
Mercer et al.

(10) Patent No.: US 6,443,387 B1
(45) Date of Patent: Sep. 3, 2002

(54) PAPER CORE TURNUP APPARATUS

(75) Inventors: Bobby R. Mercer; Rodney E. Powell, both of Crossett, AR (US)

(73) Assignee: Georgia Pacific Corporation, Atlanta, GA (US)

( * ) Notice: Subject to any disclaimer, the term of this patent is extended or adjusted under 35 U.S.C. 154(b) by 0 days.

(21) Appl. No.: 09/570,590

(22) Filed: May 12, 2000

(51) Int. Cl.[7] ..... B65H 19/28
(52) U.S. Cl. ..... 242/532.3; 242/583
(58) Field of Search ..... 242/532.3, 583

(56) References Cited

U.S. PATENT DOCUMENTS

| | | | | |
|---|---|---|---|---|
| 3,321,149 A | * | 5/1967 | Andersen et al. | 242/583 |
| 4,422,586 A | | 12/1983 | Tetro | 242/56 R |
| 4,931,130 A | | 6/1990 | Biagiotti | 156/446 |
| 5,040,738 A | | 8/1991 | Biagiotti | 242/66 |
| 5,076,878 A | | 12/1991 | McLees et al. | 156/353 |
| 5,137,225 A | | 8/1992 | Biagiotti | 242/66 |
| 5,255,865 A | | 10/1993 | Buell et al. | 242/68.5 |
| 5,453,141 A | | 9/1995 | Rodrigquez | 156/184 |
| RE35,304 E | | 7/1996 | Biagiotti | 156/446 |
| 5,671,897 A | | 9/1997 | Ogg et al. | 242/610.1 |
| 5,722,608 A | | 3/1998 | Yamazaki | 242/160.1 |
| 5,804,302 A | | 9/1998 | Tamura et al. | 428/354 |
| 5,857,641 A | | 1/1999 | Goode | 242/583 |
| 5,865,396 A | | 2/1999 | Ogg et al. | 242/610.1 |

FOREIGN PATENT DOCUMENTS

DE 91 02 456 U 6/1991

OTHER PUBLICATIONS

Copy of International Search Report from PCT/US00/31391 mailed Mar. 13, 2001.

* cited by examiner

*Primary Examiner*—John Q. Nguyen
(74) *Attorney, Agent, or Firm*—Banner & Witcoff, Ltd.

(57) ABSTRACT

A paper core turnup apparatus for wrapping a web of paper about a core at high speeds includes a cylindrical core and a plurality of double sided adhesive tape strips. Each of the tape strips extends axially along an outer surface of the core, and is spaced from adjacent tape strips a predetermined distance. In a preferred embodiment, adjacent strips are circumferentially spaced approximately 12" from one another.

20 Claims, 3 Drawing Sheets

PAPER CORE TURNUP APPARATUS

INTRODUCTION

The present invention is directed to a paper core turnup apparatus, and, more particularly, to a paper core turnup apparatus for lightweight tissue having improved turnup efficiency at relatively high speeds.

BACKGROUND

During the manufacture of paper, such as toilet paper or other lightweight tissue, a continuous web or sheet of paper product is wound about a hollow core to form a large parent roll. The parent roll is then converted into smaller rolls, suitable for consumer use. The parent roll is typically supported for rotation by a spindle extending through the hollow core. The initial step of adhering the paper to the core and beginning winding of the paper about the core to prepare a parent roll is referred to as turnup. As the paper web is formed in prior art devices, it passes over a reel drum and is cut by a device called a tailcutter. The tailcutter slices the web of paper, making a tail approximately 24–30" wide. The leading edge of the tail is adhered to a rotating core to begin the winding process. Once the tail has begun to wrap around the core, the tailcutter moves in a linear fashion along the core, expanding the width of the tail until it reaches the full width of the roll. Prior art devices deposit a strip of glue or double sided adhesive tape on the core in order to adhere the paper to the core. The strip may extend axially along the core, or may be wound about the core in a spiral fashion.

At relatively high turnup speeds, that is, speeds at or greater than 4500 fpm, the paper may not successfully adhere to the core using the prior art devices, preventing the paper from being wound about the core. It has been found that approximately 20% of the time, the paper fails to successfully be wound on the paper on the core, resulting in an efficiency of approximately 80% and, consequently, increased costs.

Another problem is that as the tail begins to wrap around a first end of the core, a larger amount of paper is wrapped about the core at this end of the core than about the rest of the core. This process produces wasted paper, may create problems as the paper winds about the core, and takes approximately 90–120 seconds to complete, reducing the efficiency of the turnup process.

Glue based adhering systems are found to be especially problematic. At higher turnup speeds, the glue can be slung outwardly off the core, reducing the efficiency of the system and increasing the waste. Since a fine paper dust is present during the manufacturing process, extra care must be taken to prevent the nozzles which dispense the glue from getting plugged up with a dried glue and paper dust composite. In certain gluing applications, the glue is deposited across a majority of the exterior surface of the core, and as the core comes into contact with the web, the paper may actually disintegrate rather than merely be cut and adhered to the core.

It is an object of the present invention to provide core tape system which reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of preferred embodiments.

SUMMARY

The principles of the invention may be used to advantage to provide a turnup apparatus for winding a web of paper about a cylindrical core at relatively high speeds, that is, speeds of approximately 4500 fpm or more, with very high efficiencies.

In accordance with a first aspect, a paper core turnup apparatus for winding a web of paper about a core includes a cylindrical core and a plurality of strips of adhesive material extending axially along the core. Each tape strip is spaced from adjacent strips a predetermined distance along a circumference of the core.

In accordance with another aspect, an apparatus for wrapping a web of paper about a core at a speed of at least about 4500 fpm includes a cylindrical core and at least three strips of adhesive material. Each strip extends axially along an outer surface of the core, wherein a second of the strips is circumferentially spaced approximately 12"–15" from a first of the strips along a circumference of the core and a third of the strips is circumferentially spaced approximately 12"–15" from the second of the strips along the circumference of the core.

In accordance with yet another aspect, a paper core apparatus includes a cylindrical core and a tape dispenser. The tape dispenser is configured to dispense a plurality of double sided adhesive tape strips axially along an outer surface of the core, with each tape strip being spaced from adjacent tape strips a predetermined distance along a circumference of the core.

From the foregoing disclosure, it will be readily apparent to those skilled in the art, that is, those who are knowledgeable or experienced in this area of technology, that the present invention provides a significant advance. Preferred embodiments of the paper core turnup apparatus of the present invention can increase the efficiency of the turnup process, improving productivity and reducing costs. These and additional features and advantages of the invention disclosed here will be further understood from the following detailed disclosure of preferred embodiments.

BRIEF DESCRIPTION OF THE DRAWINGS

Preferred embodiments are described in detail below with reference to the appended drawings.

Figure 1:
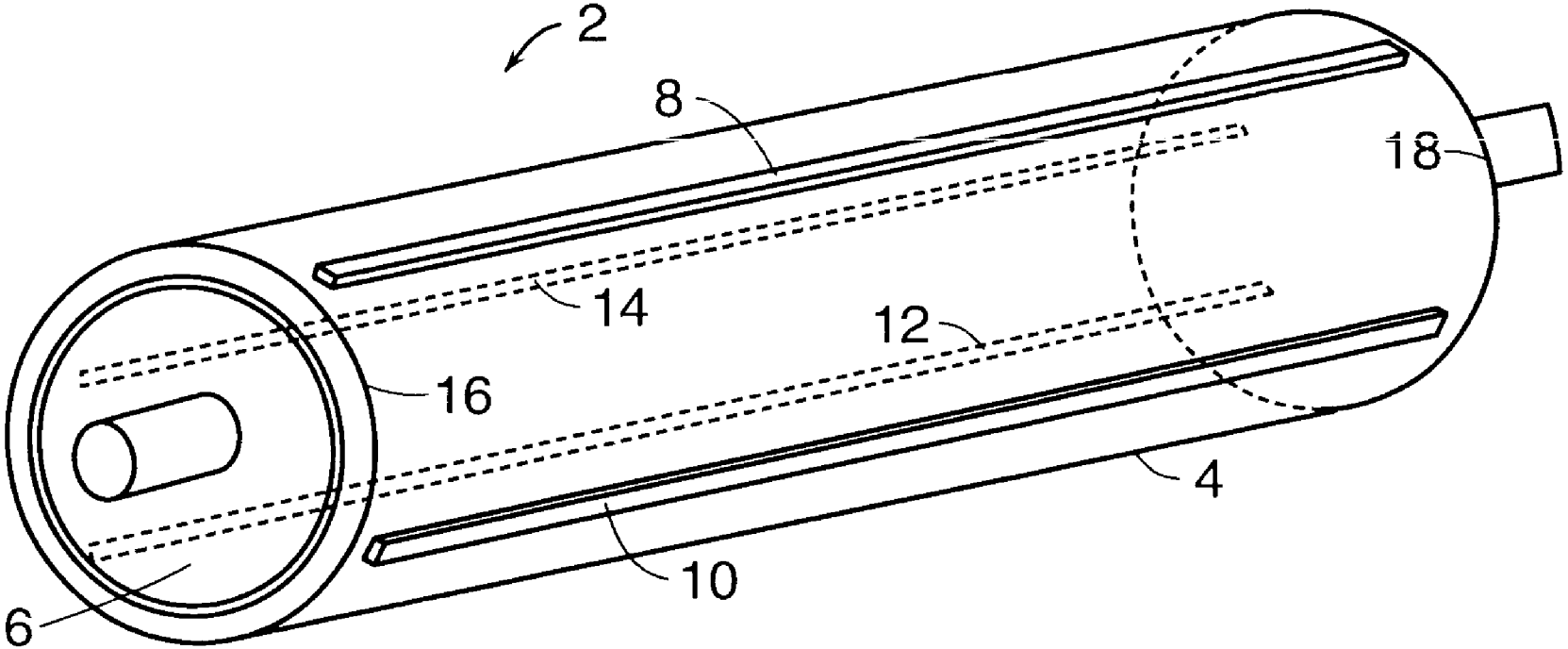
FIG. 1 is a schematic perspective view of a turnup device in accordance with the present invention.

The figures referred to above are not drawn necessarily to scale and should be understood to present a representation of the invention, illustrative of the principles involved. Some features of the turnup device depicted in the drawings have been enlarged or distorted relative to others to facilitate explanation and understanding. The same reference numbers are used in the drawings for similar or identical components and features shown in various alternative embodiments. Turnup devices as disclosed herein, will have configurations and components determined, in part, by the intended application and environment in which they are used.

DETAILED DESCRIPTION OF PREFERRED EMBODIMENTS

The present invention relates to turnup of a paper web onto a core, and is particularly applicable to applications in which the turnup speed is relatively high, that is, at or greater than 4500 fpm, where cutting the web, adhering it to the core, and successfully winding it about the core is especially problematic.

As shown in FIG. 1, a turnup device 2 in accordance with the invention comprises a hollow core 4. Core 4 is supported for rotation during turnup by spindle 6, which extends through the hollow center of core 4. A plurality of strips of adhesive material are applied axially along the surface of core 4 at a plurality of locations, each location circumferentially spaced from adjacent locations by a predetermined interval. In a preferred embodiment, the adhesive material comprises double-sided adhesive tape. In the illustrated embodiment four strips 6, 8, 10, 12 of double-sided adhesive tape, preferably repulpable tape, extend axially along the outer surface of core 4. It has been found that at least three strips of tape about core 4 are required to obtain an efficiency of approximately 99% for a core having a diameter of 16". It has also been found that providing four strips, as illustrated here, results in an efficiency greater than 99% for a 16" core. Although providing more than four strips of tape along the core would ensure that the paper web is efficiently adhered to and wrapped around the core, providing more than four strips is not particularly advantageous from a cost/benefit perspective, since the cost of providing more than four tape strips generally exceeds the cost reduction gained by the application of the tape strips.

In a preferred embodiment, tape strips 8, 10, 12 and 14 are each approximately 1" wide. A suitable double sided adhesive tape is Scotch brand 9022 tape, manufactured by Minnesota Mining and Manufacturing Company, St. Paul, Minn. It is also been found to be advantageous to provide tape strips 8, 10, 12, and 14 along less than the entire length of core 4. In particular, it has been found advantageous that tape strips 8, 10, 12, and 14 extend from a point approximately 2" from a first end 16 of core 4 to a point approximately 2" from a second end 18 of core 4. Providing tape strips 8, 10, 12, and 14 in a 1" width, and along all but the first 2" and last 2" of the length of core 4, helps to prevent sling off of the tape strips from core 4 as the core rotates at high speed. Additionally, since cores 4 are often reused, their ends can become tattered and weakened. When the tape strips are adhered to the weakened end portions, the possibility of sling off increases, since centrifugal forces more easily pull away the combination of the tape strips and the weakened portion from the core as the core rotates at high speed. Each time core 4 is reused, a new set of strips of tape are adhered to the core, the new tape strips being offset from the previously used tape strips.

Figure 2:
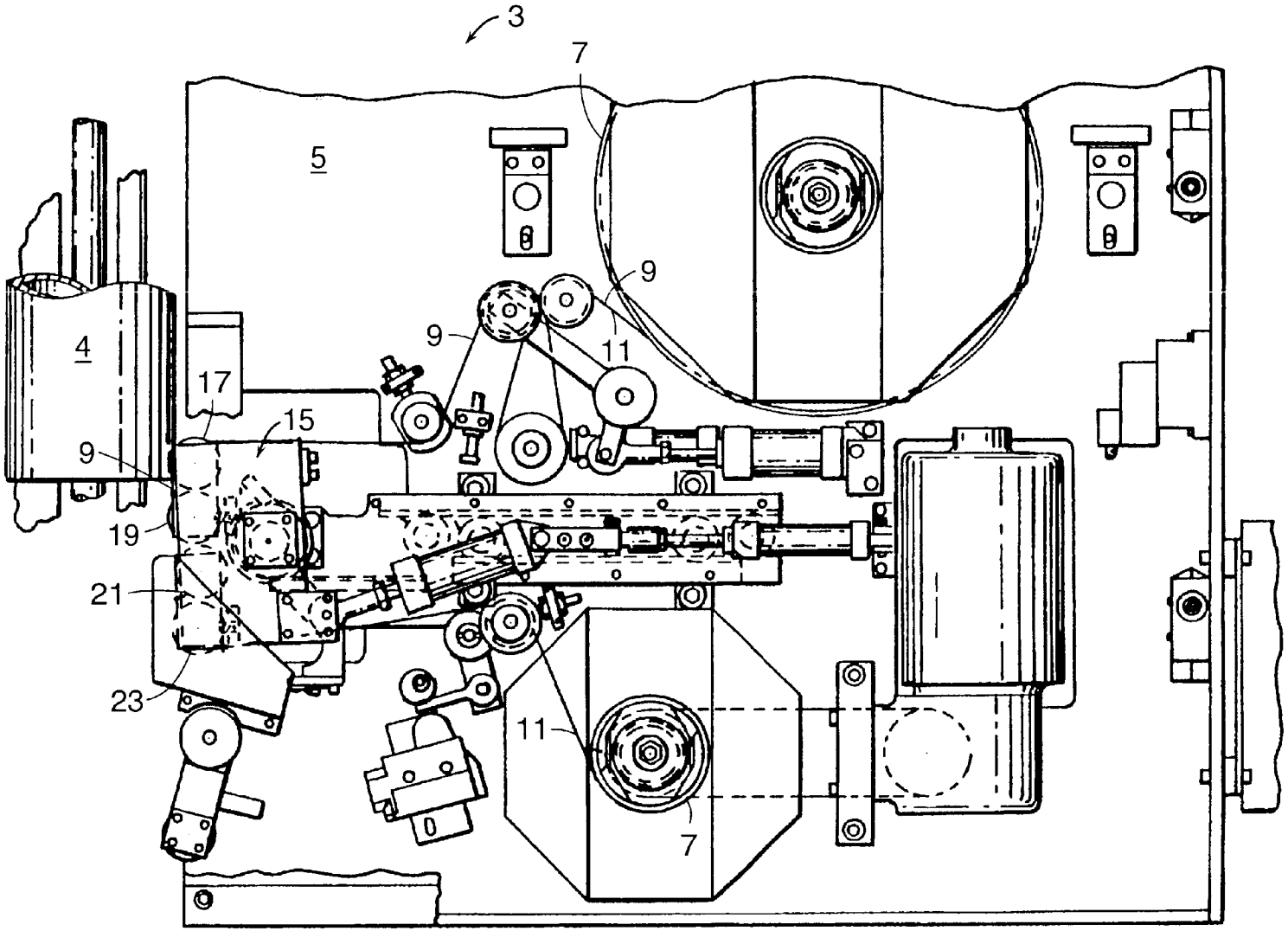
FIG. 2 is a schematic elevation view, partially cut away, of a tape dispenser shown applying a strip of adhesive tape to a core of the turnup device of FIG. 1.

A tape dispenser 3 for applying double sided adhesive tape to core 4 is shown in FIG. 2. Dispenser 3 comprises a frame 5 upon which is mounted a supply core 7. Double sided adhesive tape 9 is wound about a supply core 7 along with a release liner 11. As tape 9 is dispensed along core 4, liner, 11 peels away from the tape and is rewound on spool 7. Tape is dispensed via head 15, upon which are mounted a plurality of pressure rollers 17, 19, 21, and 23. Pressure rollers 17, 19, 21, and 23 have generally aligned surfaces to press the length of adhesive tape 9 along the surface of core 4. Dispenser 3 moves axially along core 4 in order to dispense strips of tape 9 on the exterior surface of the core. After a first strip of tape is dispensed, core 4 is rotated the required angular amount and dispenser 3 places another strip of tape 9 axially along core 4. This process is repeated until the appropriate number of strips of tape are placed along the surface of core 4. Control equipment for dispenser 3 (not shown) is programmed to dispense tape 9 along core 4 at the desired angular location, and the desired distance along core, that is, leaving an amount of core 4 proximate each end free of tape as described above. In many paper manufacturing processes, a plurality of rolls are wound about cores simultaneously. Thus, in such a configuration, dispenser 3 will be arranged to move axially along multiple cores 4 to apply tape 9 as described herein. A suitable dispenser 3 is disclosed and more fully described in U.S. Pat. No. 5,076,878 to McLees et al., owned by Minnesota Mining and Manufacturing Company, St. Paul, Minn., the entire disclosure of which is incorporated herein by reference for all purposes.

The circumferential spacing of the strips (also referred to as the segment length) of tape about the core has been found to be particularly important. It is advantageous for adjacent strips of tape to be spaced from one another by approximately 12–15", and more preferably approximately 12", which has been found to be an optimum segment length. Although spacing of less than 12" will function to increase the efficiency of the turnup device, such close spacing is found to be less cost effective, since the cost of the additional strips of tape will outweigh the benefits realized. Spacing greater than approximately 15", and more particularly, greater than 12" cannot reach the desired high efficiency.

Thus, the angular spacing of strips on a core depends on its diameter. The calculation to determine the angular spacing to create the desired segment length, is $$\text{angle}=57.296\times\text{segment length (inches)}/\text{core radius (inches)}$$

Figure 3:
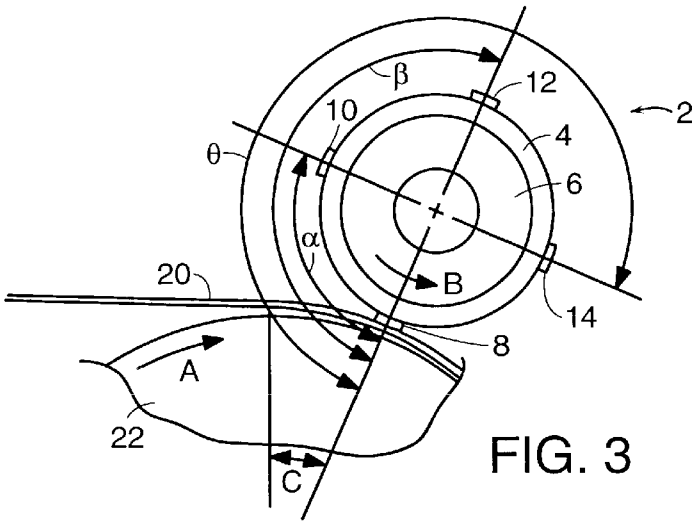
FIGS. 3–7 are elevation views of the turnup device of FIG. 1, showing the turnup device at different rotational positions as the core of the turnup device completes a full revolution.
Figure 4:
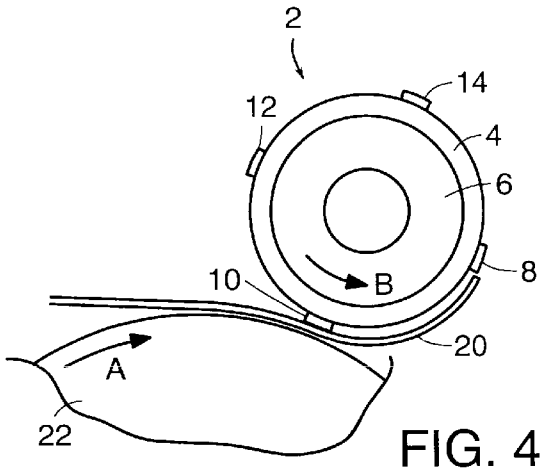

In the illustrated embodiment of FIG. 3, for a core 4 having a diameter of 16", the angle $\alpha$ between first tape strip 8 and second tape strip 10 is approximately 90°. The angle $\beta$ between first tape strip 8 and third tape strip 12 is approximately 180°, and the angle $\Theta$ between first strip 8 and fourth tape strip 14 is approximately 270°. This angular spacing creates a circumferential spacing, or segment length, between adjacent strips of approximately 12.6".

For other core diameters, angles $\alpha$, $\beta$, and $\Theta$ are calculated to provide a circumferential spacing between the strips in the range of approximately 12–15", and more preferably approximately 12". Thus, in one embodiment for a 24" core, angle $\alpha$ is approximately 57°, angle $\beta$ is approximately 114°, and angle $\Theta$ is approximately 171°. This angular spacing creates a circumferential spacing, or segment length, between adjacent strips of approximately 12".

On a 10" diameter core, it has been found that two strips of tape are sufficient, with the second strip spaced approximately 180° from the first strip, giving a circumferential spacing, or segment length, between adjacent strips of approximately 15.7".

Figure 6:
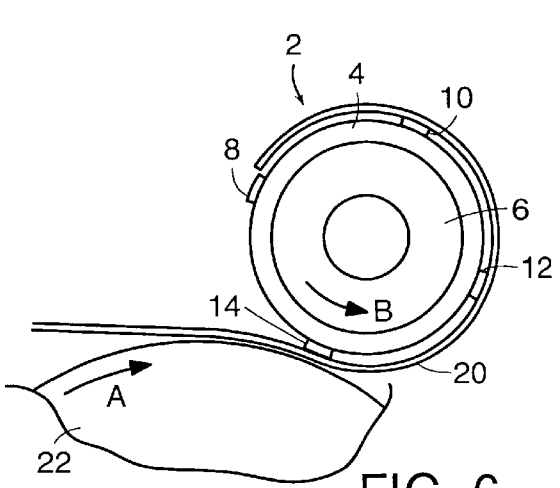
Figure 7:
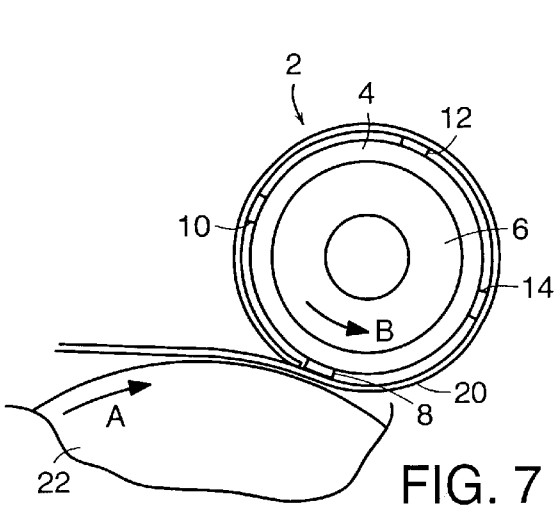
Figure 5:
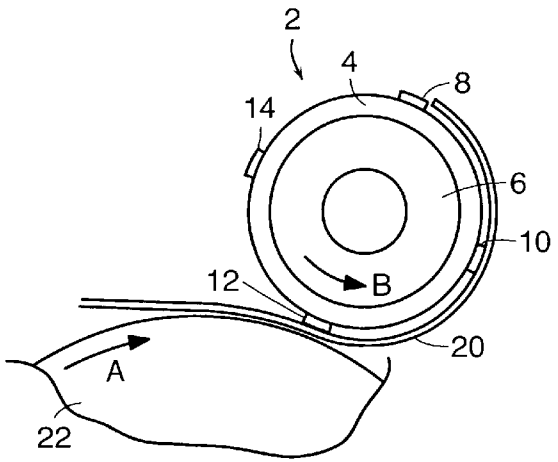

A complete revolution of core 4 during the turnup process is illustrated in FIGS. 3–7. As a web of paper 20 is manufactured, it passes over reel drum 22, which rotates in the direction of arrow A. Core 4 is also. rotating, in the direction of arrow B, and is brought into close proximity with web 20. As first tape strip 8 on rotating core 4 contacts web 20, seen in FIG. 3, web 20 is sheared and cut by the contact of tape strip 8 with web 20. As core 4 rotates further, seen in FIG. 4, second tape strip 10 adheres to web 20, and the web begins to be wound about core 4. Then, as seen in FIGS. 5–7, third tape strip 12 and fourth tape strip 14 are sequentially adhered to web 20, and web 20 continues to wrap around core 4 during the complete revolution of core 4. After one complete revolution of core 4, web 20 is securely wrapped about core 4 and the winding process will continue uninterrupted.

In a preferred embodiment, as illustrated in FIGS. 3–7, rotating core 4 is brought into contact with rotating reel drum 22 at an angle C of approximately 25° past top dead center of reel drum 22, with respect to the directions of rotation of core 4 and reel drum 22. It is important that the correct amount of pressure is applied between core 4 and reel drum 22. This pressure is referred to as the nip relief pressure. In a preferred embodiment, the nip relief pressure is approximately 2–3 lbs/linear inch. Valmet Inc. of Karlstad, Sweden, manufactures a primary arm nip relieving system which allows the nip relief pressure to be suitably managed.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A paper core turnup apparatus for winding a web of paper about a core comprising, in combination:

a cylindrical core; and a plurality of strips of adhesive material on the core and extending axially along the core, each strip spaced from adjacent strips a predetermined distance along a circumference of the core, wherein an outer surface of each strip is completely exposed such that a web of paper wound about the core will adhere to each of the strips.

2. The paper core turnup apparatus of claim 1, wherein the strips comprise double sided adhesive tape.

3. The paper core turnup apparatus of claim 2, wherein the strips are approximately 1" wide.

4. The paper core turnup apparatus of claim 1, wherein the strips extend along the core a distance less than a length of the core.

5. The paper core turnup apparatus of claim 1, wherein the strips extend along the core from a point approximately 2" from a first end of the core to a point approximately 2" from a second end of the core.

6. The paper core turnup apparatus of claim 1, wherein the circumferential displacement between adjacent strips is approximately 12–15".

7. The paper core turnup apparatus of claim 1, wherein the circumferential displacement between adjacent strips is approximately 12".

8. The paper core turnup apparatus of claim 1, further comprising a spindle extending through the core for rotating the core.

9. The paper core turnup apparatus of claim 1, further comprising a web of paper wound about the core and adhered thereto by the strips.

10. The paper core turnup apparatus of claim 1, wherein a first of the strips is angularly spaced approximately 90° from a second of the strips, and a third of the strips is angularly spaced approximately 180° from the first strip.

11. The paper core turnup apparatus of claim 10, wherein a fourth strip is angularly spaced approximately 270° from the first strip.

12. An apparatus for wrapping a web of paper about a core at a speed of at least about 4500 fpm comprising, in combination:

a cylindrical core;

at least three strips of adhesive material on the core, each strip extending axially along an outer surface of the core, wherein a second of the strips is circumferentially spaced approximately 12"–15" from a first of the strips along a circumference of the core and a third of the strips is circumferentially spaced approximately 12"–15" from the second of the strips along the circumference of the core, and an outer surface of each strip is completely exposed such that a web of paper wound about the core will adhere to each of the strips.

13. The apparatus of claim 12, wherein the second of the strips is circumferentially spaced approximately 12" from the first of the strips along a circumference of the core and the third of the strips is circumferentially spaced approximately 12" from the second of the strips along the circumference of the core.

14. The apparatus of claim 12, wherein the strips of adhesive material comprise double sided adhesive tape.

15. The apparatus of claim 14, wherein the strips of tape each have a width of approximately 1".

16. A paper core apparatus comprising, in combination:

a cylindrical core; and a tape dispenser configured to dispense a plurality of double sided adhesive tape strips onto the core axially along an outer surface of the core, each tape strip being spaced from adjacent tape strips a predetermined distance along a circumference of the core, wherein an outer surface of each tape strip is completely exposed such that a web of paper wound about the core will adhere to each of the tape strips.

17. The paper core apparatus of claim 16, wherein each tape strip is spaced from an adjacent tape strip approximately 12"–15".

18. The paper core apparatus of claim 16, wherein each tape strip is spaced from an adjacent tape strip approximately 12".

19. The paper core apparatus of claim 16, wherein the tape strips extend along the core a distance less than a length of the core.

20. The paper core apparatus of claim 19, wherein the tape strips extend along the core from a point approximately 2" from a first end of the core to a point approximately 2" from a second end of the core.

* * * * *